US007242889B2

(12) United States Patent
Ahn et al.

(10) Patent No.: US 7,242,889 B2
(45) Date of Patent: Jul. 10, 2007

(54) IMAGE FORMING APPARATUS

(75) Inventors: Byung-sun Ahn, Suwon-si (KR); Yong-kon Jo, Suwon-si (KR); Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 179 days.

(21) Appl. No.: 10/992,084

(22) Filed: Nov. 19, 2004

(65) Prior Publication Data

US 2005/0276629 A1 Dec. 15, 2005

(30) Foreign Application Priority Data

Jun. 12, 2004 (KR) ..... 10-2004-0043297

(51) Int. Cl.
*G03G 21/18* (2006.01)
*G03G 15/00* (2006.01)

(52) U.S. Cl. ..... 399/111

(58) Field of Classification Search ..... 399/111, 399/124, 125; 347/138, 152
See application file for complete search history.

(56) References Cited

U.S. PATENT DOCUMENTS 5,608,498 A * 3/1997 Nagase et al. ..... 347/138 X
5,758,232 A * 5/1998 Ikunami ..... 399/111
6,714,750 B2 * 3/2004 Terada et al. ..... 399/111
6,735,406 B1 * 5/2004 Noda ..... 399/111
2005/0047822 A1 * 3/2005 Hashimoto et al. ..... 399/111
2005/0207783 A1 * 9/2005 Sugimura et al. ..... 399/111

FOREIGN PATENT DOCUMENTS

| | | | |
|---|---|---|---|
| JP | 04-121757 | | 4/1992 |
| JP | 04-267277 | | 9/1992 |
| JP | 08-016068 A | * | 1/1996 |
| JP | 08-106244 A | * | 4/1996 |
| JP | 10-123912 A | * | 5/1998 |
| JP | 2000-132053 | | 5/2000 |
| KR | 2003-0063133 A | | 7/2003 |

* cited by examiner

*Primary Examiner*—Sophia S. Chen
(74) *Attorney, Agent, or Firm*—Stanzione & Kim, LLP

(57) ABSTRACT

An image forming apparatus includes a body frame having a cover to open or close the body frame, a process cartridge in which an image forming unit including a photosensitive drum to form an electrostatic latent image is unitized to be removably mounted in the body frame, and a guide rail formed in the body frame to guide a movement of the process cartridge, the guide rail has a process cartridge mounting position and a process cartridge removing position which is backwardly apart from the cartridge mounting position at a desired distance, and the process cartridge mounting position is located at a higher place than the process cartridge removing position.

25 Claims, 3 Drawing Sheets

IMAGE FORMING APPARATUS

CROSS-REFERENCE TO RELATED APPLICATIONS

This application claims benefit under 35 U.S.C. § 119 from Korean Patent Application No. 2004-43297, filed on Jun. 12, 2004, the entire content of which is incorporated herein by reference.

BACKGROUND OF THE INVENTION

1. Field of the Invention

The present general inventive concept relates to an image forming apparatus in which a toner image is formed on a photosensitive medium by an electrophotograph process and then transferred to a paper, thereby obtaining an image. More particularly, the present general inventive concept relates to an image forming apparatus, such as a printer, a duplicator or a facsimile machine, which is provided with a removable process cartridge in which at least one of an image forming means such as a photosensitive medium, a developing means and a cleaning means is unitized.

2. Description of the Related Art

Recently, an image forming apparatus such as a printer or a duplicator, is being much smaller and lighter as well as highly functional and sophisticated.

Meanwhile, in order for a user to facilely maintain the image forming apparatus, there has been developed an image forming apparatus with a process cartridge in which at least one of an image forming means such as a photosensitive medium, a developing means and a cleaning means is unitized.

In the image forming apparatus, such as the printeror the duplicator, with the process cartridge, if the photosensitive medium in the process cartridge is worn or aged, the process cartridge must be replaced with a new one. At this time, since the user can easily replace the corresponding cartridge without a skilled worker, maintenance of the image forming apparatus has become convenient. To this end, a process cartridge guiding member is provided in a body frame of the image forming apparatus. The process cartridge is disposed at the guiding member so as to obtain a best image.

FIG. 1 is a schematic cross-sectional view of a conventional image forming apparatus using a typical electrophotographic process.

As shown in FIG. 1, a cover 11 is provided at a body frame 10 so as to open or close the body frame 10. Further, a guide rail 12 is formed at an inner portion of the body frame 10.

Furthermore, a paper feeding unit 20 is provided at an internal lower portion of the body frame 10. The paper feeding unit 20 is provided with a paper feeding cassette 21 and a plurality of conveying rollers 22.

A transfer roller 30 constructing a transfer unit, a fixing roller 40 constructing a fixing unit and an exhausting roller 50 constructing an exhausting unit are disposed in turn from the internal lower side toward an internal upper side of the body frame 10 so as to form a substantially C-shaped paper conveying path.

A process cartridge 60 is mounted in the guide rail 12 through a space formed by opening the cover 11 of the body frame 10. The process cartridge 60 includes a photosensitive drum 61. If the process cartridge 60 is mounted in the body frame 10, the photosensitive drum 61 is in contact with the transfer roller 30. Further, the process cartridge 60 comprises a charging roller, a developing roller, a cleaning roller and a toner.

In FIG. 1, a reference numeral 70 designates an exposure unit for scanning a laser beam to the photosensitive drum 61 and forming a desired electrostatic latent image. The electrostatic latent image formed on the photosensitive drum 61 by the exposure unit 70 is developed with a toner, thereby becoming a visible image. Paper is supplied between the photosensitive drum 61 and the transfer roller 30. At this time, the visible image of the photosensitive drum 61 is transferred onto the paper. The paper, on which the image is transferred, is exhausted through the fixing roller 40 and the exhausting roller 50 to an outside.

Meanwhile, in the image forming apparatus, if the paper is jammed during a printing operation or the process cartridge has to be replaced, the process cartridge 60 is separated from its mounting position, and the jammed paper is removed or the process cartridge 60 is replaced.

At this time, in the conventional image forming apparatus, as shown in FIG. 1, since the process cartridge 60 is separated upward from the body frame 10, a separation of the process cartridge 60 is inconvenient.

Moreover, since the process cartridge 60 mounted in the guide rail 12 of the body frame 10 is suppressed by a pressing means (not shown) so as to prevent an undesired separation of the process cartridge 60, a user has to pull the process cartridge 60 with a great amount of force to separate the process cartridge from the pressing means. Further, when the process cartridge 60 is separated from the pressing means, a crashing sound is generated.

In addition, since the user has to lift the process cartridge 60, the user has to put forth his/her strength. Furthermore, since the separating process of the process cartridge 60 is performed in the body frame 10, it is difficult for the user to monitor the separating process of the process cartridge 60. Therefore, there are many problems in a replacement of the process cartridge.

SUMMARY OF THE INVENTION

An aspect of the present general inventive concept is to solve at least the above problems and/or disadvantages and to provide at least the advantages described below. Accordingly, an aspect of the present general inventive concept is to provide an image forming apparatus in which a process cartridge can be separated and mounted safely and facilely, thereby improving a user's convenience.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an image forming apparatus comprising a body frame having a cover to open or close the body frame; a process cartridge in which an image forming means including a photosensitive drum to form an electrostatic latent image may be unitized so as to be removably mounted in the body frame; and a guide rail formed in the body frame so as to guide a movement of the process cartridge, wherein the guide rail may have a process cartridge mounting position and a process cartridge removing position which may be backwardly apart from the cartridge mounting position at a desired distance, and the process cartridge mounting position may be located at a higher place than the process cartridge removing position.

According to an aspect of the present general inventive concept, the guide rail may be formed with a horizontal rail portion extending from the cover toward the process cartridge removing position, and an inclined rail portion inclinedly extending from the process cartridge removing position toward the process cartridge mounting position, and the process cartridge mounting position may be formed with a groove to accommodate and support a shaft of the photosensitive drum.

The image forming apparatus according to another aspect of the present general inventive concept may further comprise an exposure unit to scan a laser beam to the photosensitive drum and form an electrostatic latent image on the photosensitive drum; and a paper feeding unit having a paper feeding cassette and a plurality of paper conveying rollers disposed in a lower side of the body frame, to feed papers so as to be passed by the photosensitive drum, wherein the process cartridge can be horizontally moved between the exposure unit and the paper feeding cassette.

The process cartridge may be held at the process cartridge mounting position by a groove formed at the process cartridge mounting position, and if the process cartridge is separated from the groove, it may be moved to the process cartridge removing position by its own weight along the inclined rail portion.

The process cartridge may have a handle for a user's convenience.

The image forming apparatus may further comprise a paper conveying path formed against a gravity direction from the paper feeding unit in the form of a substantial C-shape; a transfer unit disposed at the paper conveying path and including a transfer roller to transfer the image on the photosensitive drum to the paper passing between the photosensitive drum and the transfer roller; a fixing unit disposed at a downstream of the transfer unit and including a pair of fixing rollers to fix the image transferred to the paper; and an exhausting unit including a pair of exhausting rollers to exhaust the paper externally.

The process cartridge may comprise toner, a cartridge frame to store the toner and also to rotatably support the photosensitive drum, a developing roller to move and attach the toner to the toner to the photosensitive drum, and a metering roller to control a toner layer attached on the developing roller within a range of thickness.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
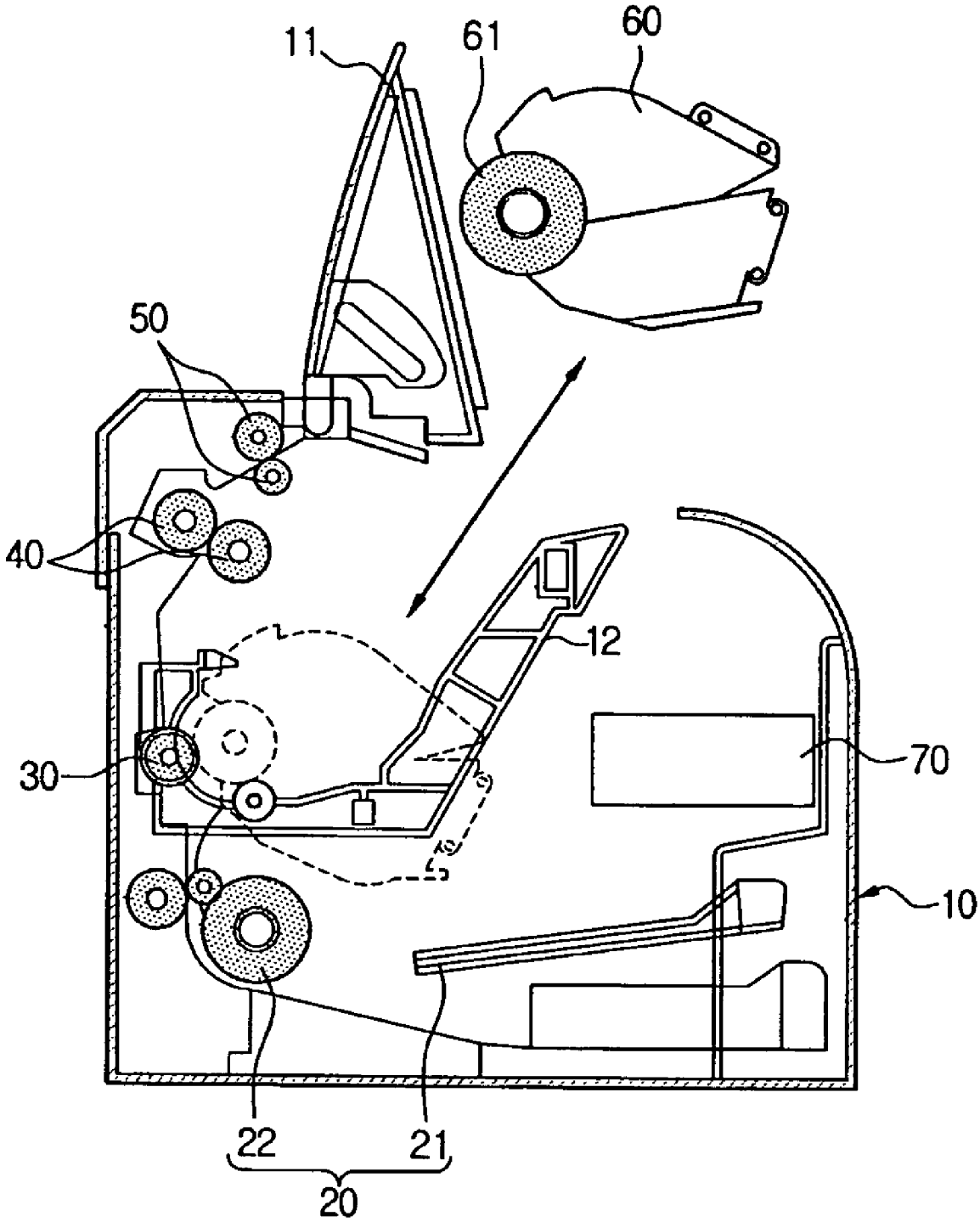
FIG. 1 (PRIOR ART)
FIG. 1 is a schematic cross-sectional view of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
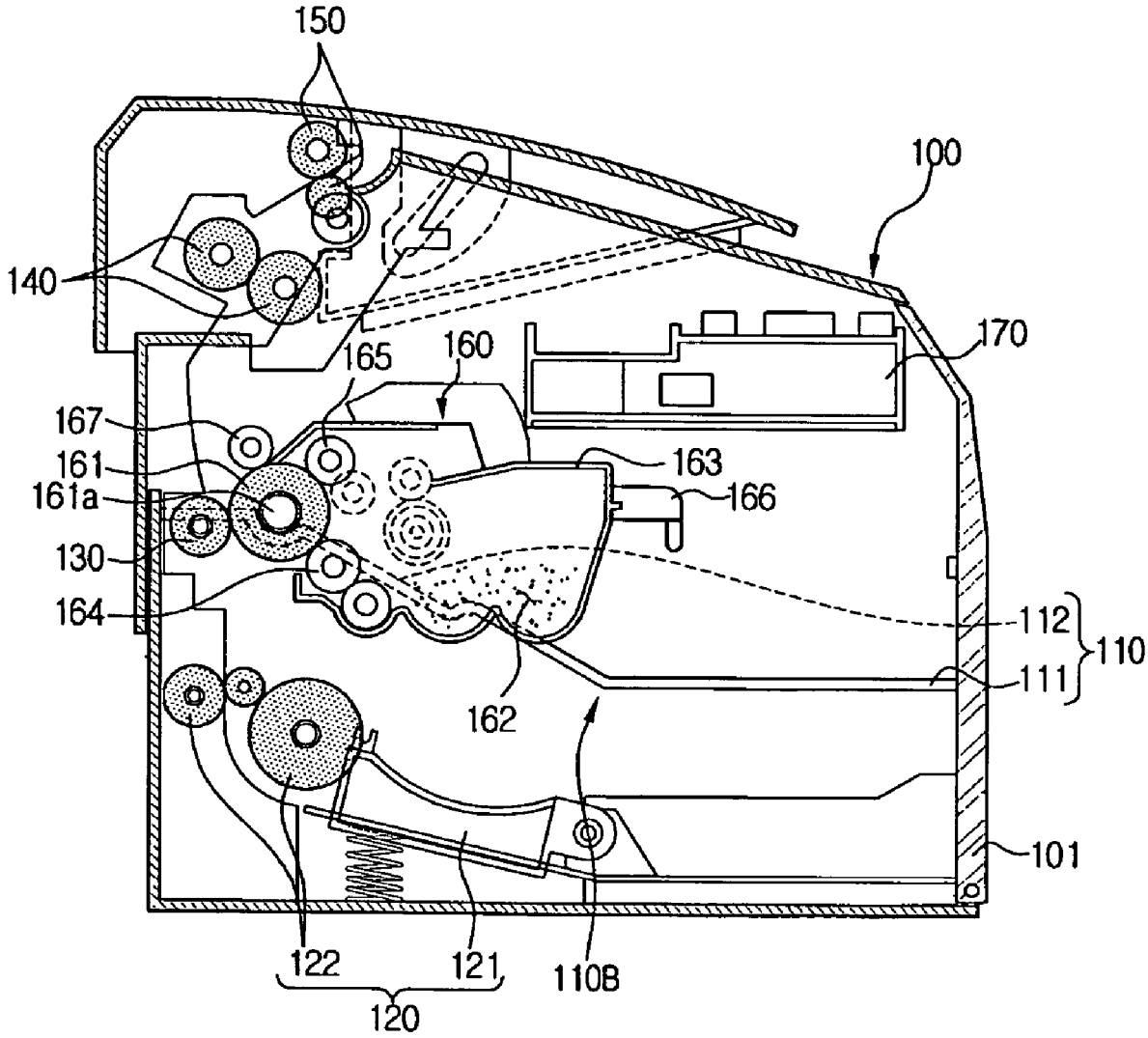
FIG. 2 is a schematic cross-sectional view of an image forming apparatus according to an embodiment of the present general inventive concept, with a process cartridge mounted.
Figure 3:
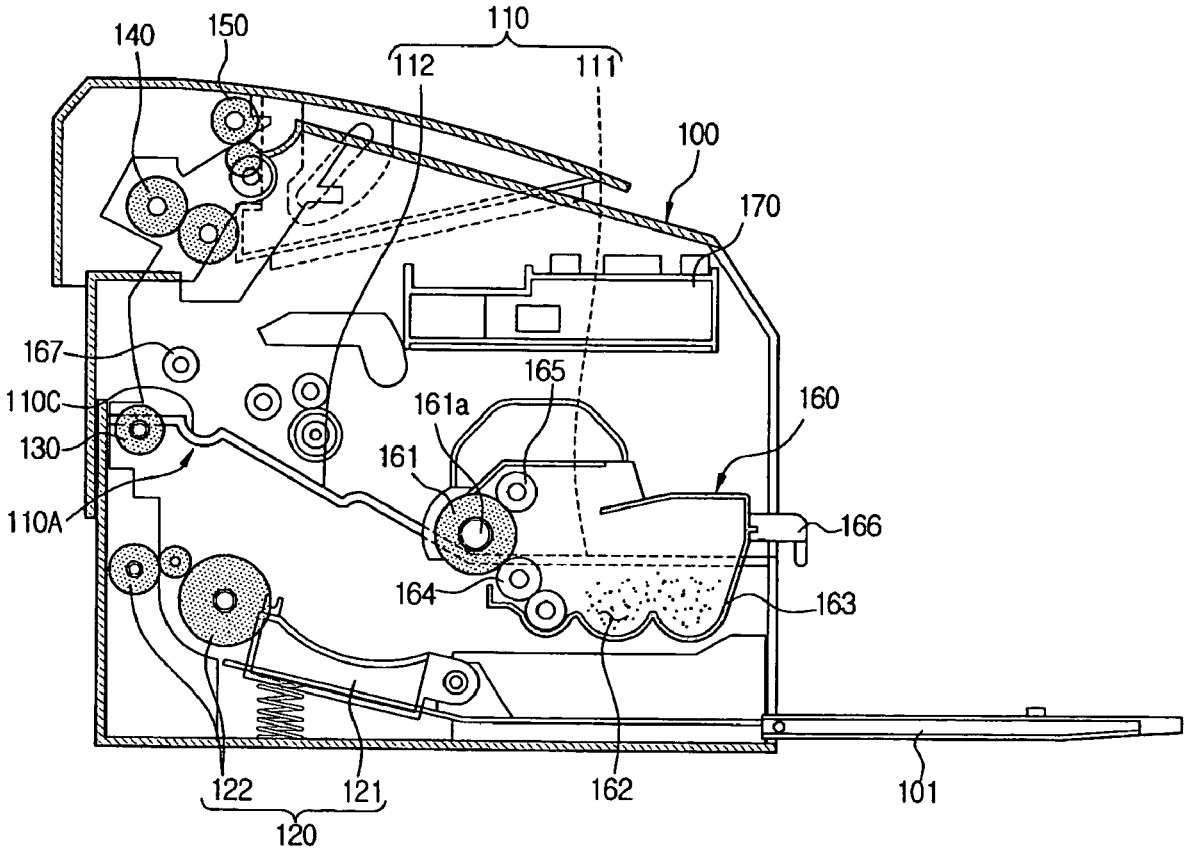
FIG. 3 is a cross-sectional view of the image forming apparatus of the FIG. 2, with a process cartridge removed.

As shown in FIGS. 2 and 3, an image forming apparatus according to an embodiment of the present general inventive concept may have a paper feeding unit 120 in a lower portion of a body frame 100. A paper conveying path may be formed from the paper feeding unit 120 in the form of a substantial C-shape.

The paper feeding unit 120 may be provided with a paper feeding cassette 121 in which a large amount of paper may be loaded and a plurality of paper conveying rollers 122 to convey the paper to the paper conveying path. At the paper conveying path, there may be disposed in turn a transfer roller 130 constructing a transfer unit, a pair of fixing rollers 140 constructing a fixing unit and a pair of exhausting rollers 150 constructing an exhausting unit at desired intervals.

Furthermore, a cover 101 is disposed at a side of the body frame 100 so as to open or close a part of the body frame 100. A guide rail 110 to guide a process cartridge 160 is formed in an inner portion of the body frame 100.

The guide rail 110 may have a process cartridge mounting position 110A and a process cartridge removing position 110B as illustrated. The process cartridge mounting position 110A is located at a higher place than the process cartridge removing position 110B.

Further, the guide rail 110 may comprise a horizontal rail portion 111 extending from the cover 101 toward the process cartridge removing position 110B, and an inclined rail portion 112 inclinedly extending from the process cartridge removing position 110B toward the process cartridge mounting position 110A.

In addition, the process cartridge mounting position 110A may be formed with a groove 110C to accommodate and support a shaft 161*a* of a photosensitive drum 161 of the process cartridge 160, and thereby prevent a separation of the process cartridge 160 from the process cartridge mounting position 110A.

The process cartridge 160 may be held at the process cartridge mounting position 110A so that the shaft 161*a* of the photosensitive drum 161 of the process cartridge 160 is inserted into the groove 110C of the process cartridge mounting position 110A. If the process cartridge 160 is separated from the groove 110C, it may be moved to a lower side by its own weight along the inclined rail portion 112 and placed at the process cartridge removing position 110B. Therefore, a user can facilely remove the process cartridge 160 from the body frame 100.

When the process cartridge 160 is mounted in the body frame 100, the user may open the cover 101, place the process cartridge 160 at the horizontal rail portion 111, and push up the process cartridge 160 along the inclined rail portion 112. Thus, the process cartridge 160 may be moved through the process cartridge removing position 110B and the inclined rail portion 112 to the groove 110C of the process cartridge mounting position 110A. If the shaft 161*a* of the photosensitive drum 161 is inserted into the groove 110C, the process cartridge 160 is completely mounted in the body frame 100.

In the image forming apparatus according to the present general inventive concept, as described above, the process cartridge 160 can be safely and conveniently mounted in or removed from the body frame 100.

Furthermore, the process cartridge 160 may comprise toner 162, a cartridge frame 163 to store the toner 162 and also to rotatably support the photosensitive drum 161, a developing roller 164 to move and attach the toner 162 to the photosensitive drum 161, and a metering roller 165 to control a toner layer attached on the developing roller 164 within a range of thickness.

Further, the process cartridge 160 may be provided with a handle 166. The user may use the handle 166 to conveniently mount or remove the process cartridge 160.

According to an aspect of the present general inventive concept, the image forming apparatus may also have a charging roller 167 constructing a charging unit, and an exposure unit 170 to scan a laser beam to the photosensitive drum 161 and form an electrostatic latent image on the photosensitive drum 161.

As shown in FIGS. 2 and 3, the exposure unit 170 may be disposed at an upper side of the body frame 100. The guide rail 110 may be disposed between the exposure unit 170 and the paper feeding cassette 121, so that the process cartridge 160 can be horizontally moved between the exposure unit 170 and the paper feeding cassette 121.

According to an aspect of the present general inventive concept, as described above the process cartridge can be stably and conveniently mounted or removed, thereby improving a convenience of the user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a body frame having a cover to open or close the body frame;

a process cartridge in which an image forming unit including a photosensitive drum to form an electrostatic latent image is unitized to be removably mounted in the body frame; and a guide rail formed in the body frame to guide a movement of the process cartridge, wherein the guide rail has a process cartridge mounting position and a process cartridge removing position which is spaced apart from the cartridge mounting position at a desired distance, and the process cartridge mounting position is located at a higher place than the process cartridge removing position such that when the process cartridge is located at the process cartridge mounting position, the process cartridge is higher than when the process cartridge is located at the process cartridge removing position.

2. The apparatus as claimed in claim 1, wherein the guide rail comprises:

a horizontal rail portion extending from the cover toward the process cartridge removing position; and an inclined rail portion inclined and extending from the process cartridge removing position toward the process cartridge mounting position, the inclined rail portion having a groove to accommodate and support a shaft of the photosensitive drum at the process carriage mounting position.

3. The apparatus as claimed in claim 2, further comprising:

an exposure unit to scan a laser beam to the photosensitive drum to form an electrostatic latent image on the photosensitive drum; and a paper feeding unit having a paper feeding cassette and a plurality of paper conveying rollers disposed in a lower side of the body frame to feed paper to be passed by the photosensitive drum, wherein the process cartridge can be horizontally moved between the exposure unit and the paper feeding cassette.

4. The apparatus as claimed in claim 3, wherein the process cartridge is held at the process cartridge mounting position by the groove, and when separated from the groove, the process cartridge is moved to the process cartridge removing position by its own weight along the inclined rail portion.

5. The apparatus as claimed in claim 4, wherein the process cartridge has a handle for a user's convenience.

6. The apparatus as claimed in claim 3, further comprising:

a paper conveying path formed against a gravity direction from the paper feeding unit in the form of a substantial C-shape;

a transfer unit disposed at the paper conveying path and including a transfer roller to transfer the image on the photosensitive drum to the paper passing between the photosensitive drum and the transfer roller;

a fixing unit disposed at a downstream of the transfer unit and including a pair of fixing rollers to fix the image transferred to the paper; and an exhausting unit including a pair of exhausting rollers to exhaust the paper to an outside.

7. The apparatus as claimed in claim 6, wherein the process cartridge comprises toner, a cartridge frame to store the toner and also to rotatably support the photosensitive drum, a developing roller to move and attach the toner to the photosensitive drum, and a metering roller to control a toner layer attached on the developing roller within a range of thickness.

8. An image forming apparatus comprising:

a body frame having an access door disposed on a side portion thereof;

a horizontally removable process cartridge disposed at an operating position; and a guiding unit formed in the body frame and including a portion inclined upward in a mounting direction to the operation position to guide a movement of the process cartridge between the operating position and the access door.

9. The apparatus as claimed in claim 8, wherein the process cartridge unitizes an image forming unit including a photosensitive drum to form an electrostatic latent image.

10. The apparatus as claimed in claim 9, wherein the guiding unit comprises:

a horizontal rail portion extending from the access door inward;

an inclined rail portion coupled to the horizontal rail portion and extending from the horizontal rail portion to the operating position; and a groove formed in the inclined rail portion at the operating position to accommodate a shaft of the photosensitive drum and to hold the process cartridge at the operating position.

11. The apparatus as claimed in claim 10, wherein the process cartridge is held at the operating position by the groove, and when separated from the groove the process cartridge is moved along the inclined rail portion by its own weight to rest on the horizontal rail portion.

12. The apparatus as claimed in claim 10, wherein the process cartridge has a handle.

13. The apparatus as claimed in claim 10, further comprising:

an exposure unit to scan a laser beam to the photosensitive drum to form the electrostatic latent image on the photosensitive drum; and a paper feeding unit having a paper feeding cassette and a plurality of paper conveying rollers disposed in a lower side of the body frame to feed paper so as to be passed by the photosensitive drum, wherein the process cartridge can be horizontally moved between the exposure unit and the paper feeding cassette.

14. The apparatus as claimed in claim 13, further comprising:

a paper conveying path formed against a gravity direction from the paper feeding unit in the form of a substantial C-shape;

a transfer unit disposed at the paper conveying path and including a transfer roller to transfer the image on the photosensitive drum to the paper passing between the photosensitive drum and the transfer roller;

a fixing unit disposed at a downstream of the transfer unit and including a pair of fixing rollers to fix the image transferred to the paper; and an exhausting unit including a pair of exhausting rollers to exhaust the paper externally.

15. The apparatus as claimed in claim 14, wherein the process cartridge comprises toner, a cartridge frame to store the toner and to rotatably support the photosensitive drum, a developing roller to move and attach the toner to the photosensitive drum, and a metering roller to control a toner layer attached on the developing roller within a range of thickness.

16. The apparatus as claimed in claim 8, wherein the process cartridge unitizes at least one of an image forming unit, a developing unit, and a cleaning unit.

17. An image forming apparatus comprising:

a frame including a door positioned at a side portion thereof;

a process cartridge including a photosensitive drum to form an image thereon; and a guide rail formed within the frame to hold the process cartridge in an operating position, the guide rail having a bent shape such that when the process cartridge is freed from the operating position, the process cartridge slides along a first portion of the guide rail due to a gravitational force and rests at a second portion of the guide rail adjacent to the door to be horizontally removed.

18. A method of mounting a process cartridge in a body frame of an image forming apparatus, the method comprising:

opening a cover disposed at a side of a body frame;

placing a process cartridge onto a horizontal rail portion of a guide rail;

pushing the process cartridge up an inclined portion of the guide rail; and inserting a shaft of the process cartridge into a groove of the guide rail.

19. The method as claimed in claim 18, wherein the process cartridge unitizes at least one of an image forming unit, a developing unit, and a cleaning unit.

20. The method as claimed in claim 18, wherein the shaft is formed in a photosensitive drum of the process cartridge.

21. A method of removing a process cartridge from a body frame of an image forming apparatus, the method comprising:

opening a cover disposed at a side of a body frame;

separating a shaft of a process cartridge from a groove in a guide rail;

moving the process cartridge down an inclined rail portion of the guide rail to come to rest on a horizontal rail portion of the guide rail; and extracting the process cartridge horizontally from the side of the body frame.

22. The method as claimed in claim 21, wherein the process cartridge unitizes at least one of an image forming unit, a developing unit, and a cleaning unit.

23. The method as claimed in claim 21, wherein the shaft is formed in a photosensitive drum of the process cartridge.

24. The method as claimed in claim 21, wherein the moving of the process cartridge down the inclined rail portion comprises allowing the process cartridge to move along the inclined rail portion by its own weight.

25. An image forming apparatus, comprising:

a frame having a side opening;

a process cartridge mountable in the frame, the process cartridge including a photosensitive unit and a developing unit to attach toner to the photosensitive unit;

an exposing unit to form a latent image on the photosensitive unit;

a print medium conveying unit to convey a print medium towards the photosensitive unit; and a guiding unit disposed between the exposure unit and the print medium conveying unit to guide a mounting and dismounting of the process cartridge in the frame, the guiding unit including an inclined portion to receive the process cartridge inclined away from the side opening and a horizontal portion extending towards the side opening to guide the process cartridge between the exposure unit and the print medium conveying unit.

* * * * *